US010364777B2

(12) United States Patent
Murakami et al.

(10) Patent No.: US 10,364,777 B2
(45) Date of Patent: Jul. 30, 2019

(54) INTAKE APPARATUS OF V-TYPE INTERNAL COMBUSTION ENGINE

(71) Applicant: HONDA MOTOR CO., LTD., Tokyo (JP)

(72) Inventors: Mitsunori Murakami, Wako (JP); Yuki Tomitani, Wako (JP); Kenta Obana, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/584,024

(22) Filed: May 2, 2017

(65) Prior Publication Data

US 2017/0321637 A1 Nov. 9, 2017

(30) Foreign Application Priority Data

May 9, 2016 (JP) ..... 2016-093836

(51) Int. Cl.
*F02M 35/116* (2006.01)
*F02M 35/10* (2006.01)
*F02B 75/22* (2006.01)

(52) U.S. Cl.
CPC ..... *F02M 35/10026* (2013.01); *F02B 75/22* (2013.01); *F02M 35/10078* (2013.01); *F02M 35/10288* (2013.01); *F02M 35/116* (2013.01)

(58) Field of Classification Search
CPC ..... F02M 35/10078; F02M 35/10118; F02M 35/10288; F02M 35/116; F02B 75/22
USPC ..... 123/184.24, 184.31, 184.34, 184.47, 123/184.53
See application file for complete search history.

(56) References Cited

U.S. PATENT DOCUMENTS 2,382,244 A * 8/1945 Lundquist ..... F02B 27/00 123/184.34
2,871,842 A * 2/1959 Dolza ..... F02B 27/00 123/184.34
2,909,165 A * 10/1959 Dolza ..... F02B 27/00 123/184.34
3,282,572 A * 11/1966 Karlovitz ..... F02D 11/08 123/184.34

(Continued)

FOREIGN PATENT DOCUMENTS

DE 4013782 A1 * 10/1991 ..... F02B 27/00
DE 4326160 A1 * 2/1995 ..... F02B 29/0405

(Continued)

*Primary Examiner* — John M Zaleskas
(74) *Attorney, Agent, or Firm* — Mori & Ward, LLP

(57) ABSTRACT

An intake apparatus of a V-type internal combustion engine including first cylinders arranged along a first direction in a first bank and second cylinders arranged along the first direction in a second bank, the intake apparatus includes a surge tank, first branch paths, second branch paths, and a protrusion. The surge tank is provided above the first and second banks. The surge tank includes a lower wall, an air inlet, first air outlets, and second air outlets. The first air outlets are arranged along the first direction in the lower wall. The second air outlets are arranged along the first direction in the lower wall. The first branch paths connect the first outlets to the first cylinders. The second branch paths connect the second outlets to the second cylinders. The protrusion is provided on the lower wall between a closest first air outlet and a closest second air outlet.

16 Claims, 7 Drawing Sheets

(56) References Cited

U.S. PATENT DOCUMENTS 4,889,083 A * 12/1989 Honma ..... F02B 75/22 123/184.34
4,895,112 A * 1/1990 Rutschmann ..... F02B 27/00 123/184.31
5,535,717 A * 7/1996 Rygiel ..... F02D 9/02 123/306
5,603,295 A * 2/1997 Topfer ..... F02M 35/10039 123/184.42
5,884,612 A * 3/1999 Takeyama ..... F01M 13/022 123/568.17
6,216,656 B1 * 4/2001 Hada ..... F02M 35/10039 123/184.34
6,973,912 B1 * 12/2005 Shimatsu ..... F02D 41/18 123/339.1
2002/0088227 A1 * 7/2002 Jarvi ..... F02B 75/22 60/602
2010/0242892 A1 * 9/2010 Takakuwa ..... F02M 35/10039 123/184.53
2011/0132310 A1 * 6/2011 Born ..... F02M 35/10019 123/184.21
2011/0315109 A1 * 12/2011 Nomura ..... F02M 35/10327 123/184.47

FOREIGN PATENT DOCUMENTS

DE 102004036514 A1 * 3/2006 ..... F02M 35/10039
DE 102005050232 A1 * 4/2007 ..... F02M 35/116
JP 05099079 A * 4/1993 ..... F02D 9/02 123/306
JP 11125159 A * 5/1999 ..... F02B 5/22
JP 4432678 B2 3/2006
JP 2009156149 A * 7/2009
JP 2009167899 A * 7/2009 ..... F02B 75/22
JP 2010270734 A * 12/2010

* cited by examiner

INTAKE APPARATUS OF V-TYPE INTERNAL COMBUSTION ENGINE

CROSS-REFERENCE TO RELATED APPLICATIONS

The present application claims priority under 35 U. S. C. § 119 to Japanese Patent Application No. 2016-093836, filed May 9, 2016. The contents of this application are incorporated herein by reference in their entirety.

BACKGROUND OF THE INVENTION

Field of the Invention

The present invention relates to an intake apparatus of a V-type internal combustion engine.

Discussion of the Background

The publication of Japanese Patent No. 4432678 describes an intake apparatus having a surge tank (collector) provided above two banks of a V-type internal combustion engine. The surge tank of this apparatus is configured so that a lower side member (lower collector) and an upper side member (upper collector) are combined by a bolt at a boss unit, and is characterized in that the boss unit is located at a position where the boss unit does not increase the intake resistance.

SUMMARY

According to one aspect of the present invention, an intake apparatus of a V-type internal combustion engine in which a plurality of cylinders are arranged in a first bank and a second bank, the intake apparatus includes a surge tank, an intake path, and a branch path. The surge tank is arranged above the first and second banks. The intake path is connected to an air inlet of the surge tank. The branch path allows communication between the surge tank and a combustion chamber each of the plurality of cylinders. The surge tank includes a plurality of first air outlets in which upstream ends of branch paths in communication with the combustion chambers of the cylinders in the first bank are open and which are arranged in a cylinder row direction of the first bank and a plurality of second air outlets in which upstream ends of branch paths in communication with the combustion chambers of the cylinders in the second bank are open and which are arranged in a cylinder row direction of the second bank. The air inlet is arranged at one end in the cylinder row direction of the first and second banks. A protrusion unit for suppressing an air flow rate of air flowing out from two particular air outlets which are of the first and second air outlets and which are close to the air inlet is provided on a lower wall surface between the two particular air outlets.

According to another aspect of the present invention, an intake apparatus of a V-type internal combustion engine including first cylinders arranged along a first direction in a first bank and second cylinders arranged along the first direction in a second bank, the intake apparatus includes a surge tank, an intake path, first branch paths, second branch paths, and a protrusion. The surge tank is provided above the first bank and the second bank in a height direction of the V-type internal combustion engine. The surge tank includes a first end, a second end, an upper wall, a lower wall, an air inlet, first air outlets, and second air outlets. The second end is opposite to the first end in the first direction. The lower wall is opposite to the upper wall in the height direction. The air inlet is provided in the first end. The first air outlets are arranged along the first direction in the lower wall. The first air outlets include a closest first air outlet closest to the air inlet among the first air outlets. The second air outlets are arranged along the first direction in the lower wall. The second air outlets include a closest second air outlet closest to the air inlet among the second air outlets. The intake path is connected to the air inlet. The first branch paths connect the first outlets to the first cylinders, respectively. The second branch paths connect the second outlets to the second cylinders, respectively. The protrusion is provided on the lower wall to protrude toward the upper wall between the closest first air outlet and the closest second air outlet so as to suppress air flows output from the closest first air outlet and the closest second air outlet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
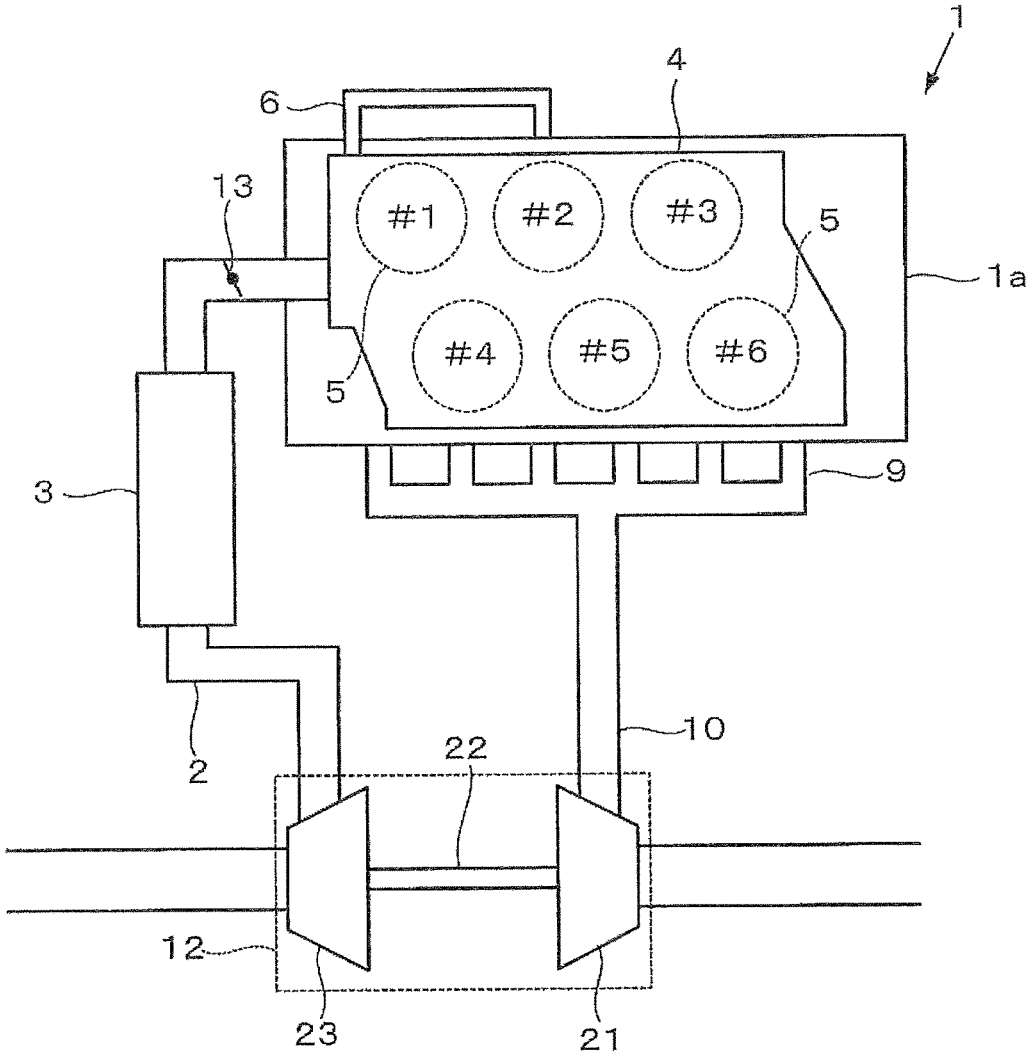
FIG. 1 is a diagram schematically illustrating a configuration of a V-type internal combustion engine according to an embodiment of the present invention.

The embodiments will now be described with reference to the accompanying drawings, wherein like reference numerals designate corresponding or identical elements throughout the various drawings.

Figure 2:
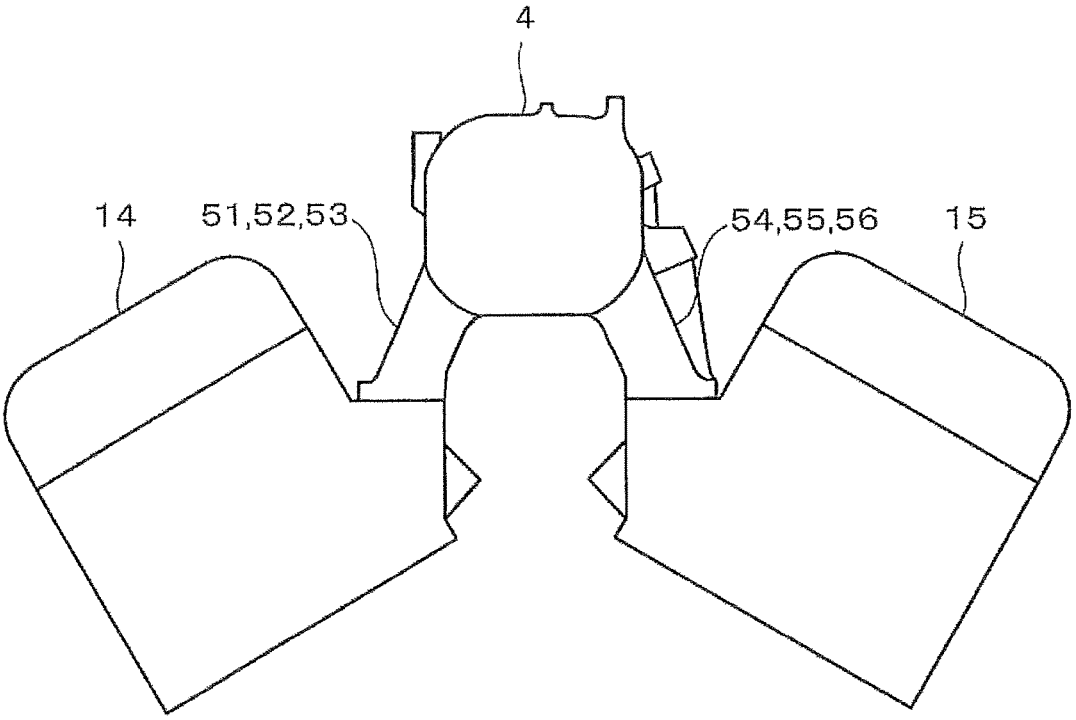
FIG. 2 is a schematic diagram for explaining a connection between a surge tank provided above the internal combustion engine main body shown in FIG. 1 and the internal combustion engine main body.

Embodiments of the present invention will be described below with reference to the drawings. FIG. 1 is a diagram schematically illustrating a configuration of a V-type internal combustion engine according to an embodiment of the present invention. FIG. 2 is a schematic diagram for explaining a connection between a surge tank 4 provided above a main body 1*a* of an internal combustion engine 1 (hereinafter referred to as an "engine") and an engine main body 1*a*. The engine 1 has six cylinders 5. The cylinders #1, #2, and #3 are arranged in a first bank 14. The cylinders #4, #5, and #6 are arranged in a second bank 15.

The engine 1 has an intake path 2, a discharge path 10, and a turbocharger (supercharger) 12. The intake path 2 is connected to the surge tank 4, and the surge tank 4 is connected to the combustion chamber of each cylinder 5 via branch paths 51 to 56. The branch paths 51, 52, and 53 are connected to the intake ports of the cylinders #1, #2, #3, respectively, of the first bank 14. The branch paths 54, 55, and 56 are connected to the intake ports of the cylinders #4, #5, #6, respectively, of the second bank 15. The surge tank 4 and the branch paths 51 to 56 are integrally formed with synthetic resin. A fuel injection valve (not shown) for injecting fuel is provided in the intake port communicating with the combustion chamber of each cylinder. The surge tank 4 is connected with a blow-by gas path 6 that communicates with a crankcase (not shown) in the engine main body 1*a*.

The intake path 2 is provided with an intercooler 3 for cooling the pressurized air and a throttle valve 13. The turbo charger 12 is provided in the discharge path 9. The turbo charger includes a turbine 21 driven to rotate by the kinetic energy of discharge and a compressor 23 connected to the turbine 21 via a shaft 22. The compressor 23 is provided in the intake path 2 and pressurizes (compresses) the air sucked into the engine 1.

Figure 3A:
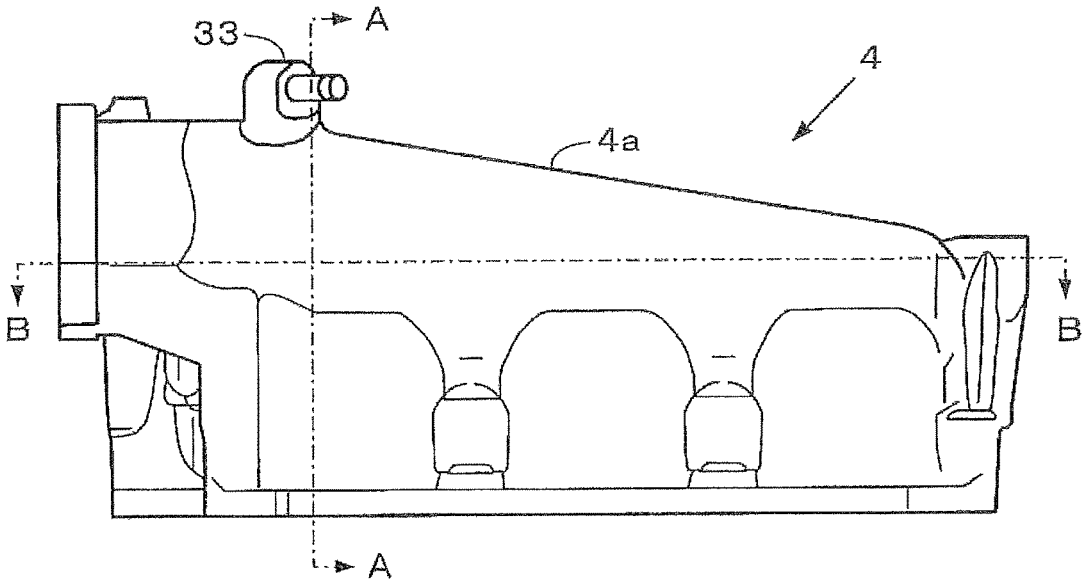
FIGS. 3A and 3B are views (a side view, a sectional view) for explaining a distinctive structure of the surge tank shown in FIG. 1.
Figure 3B:
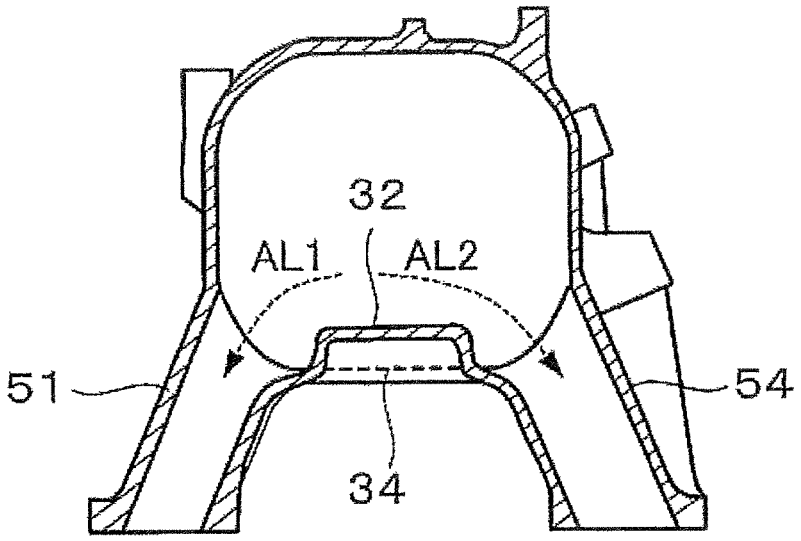
Figure 4A:
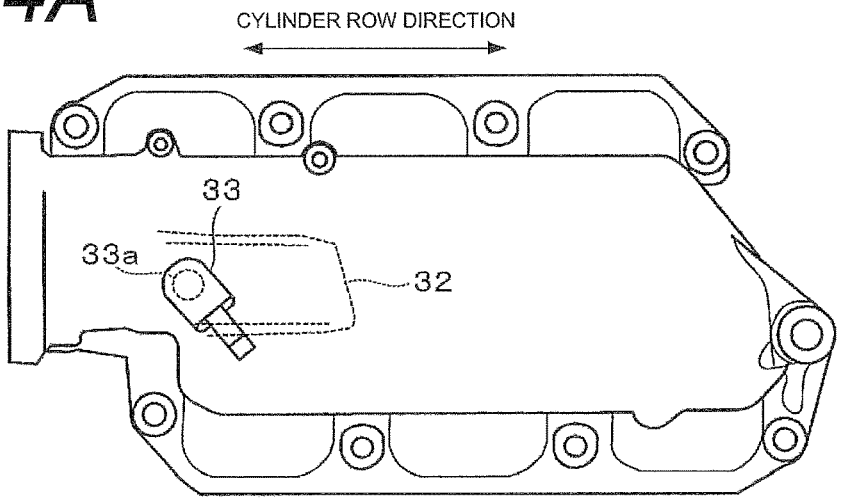
FIGS. 4A to 4C are views (a plan view, sectional views) for explaining a distinctive structure of the surge tank shown in FIG. 1.
Figure 4B:
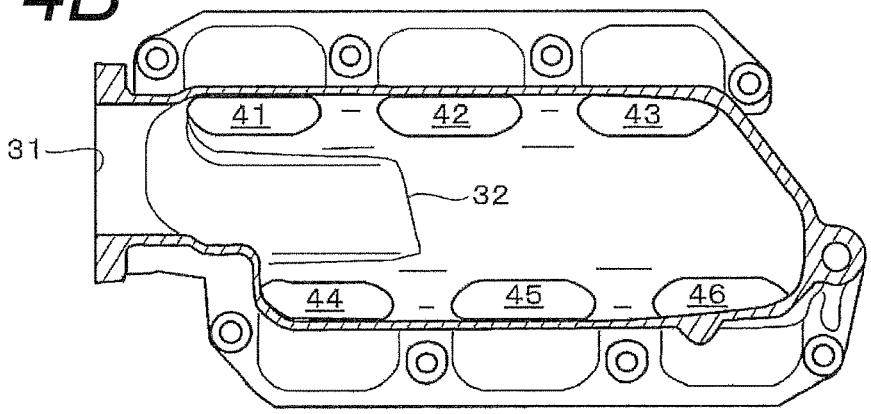
Figure 4C:
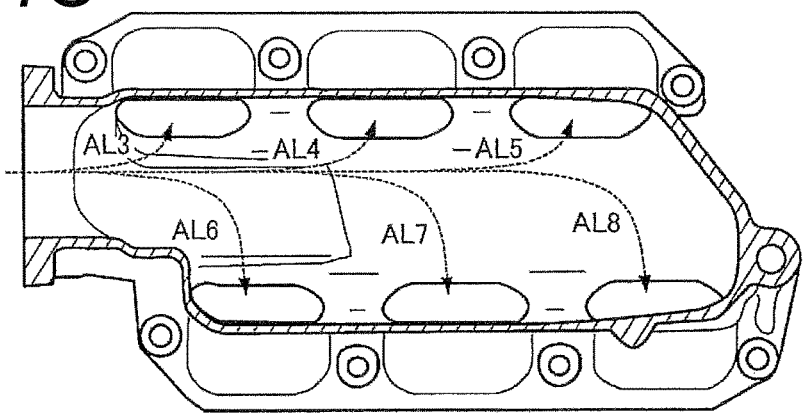
Figure 5A:
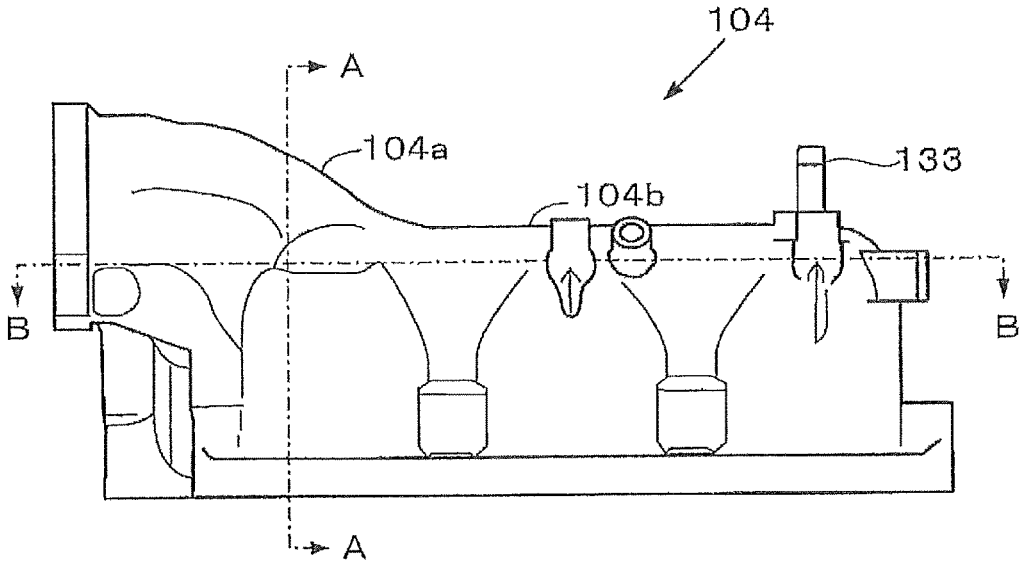
FIG. 5A CONVENTIONAL ART
FIGS. 5A and 5B are views (a side view, a sectional view) for explaining a structure of a conventional surge tank which is shown for the sake of comparison.
Figure 5B:
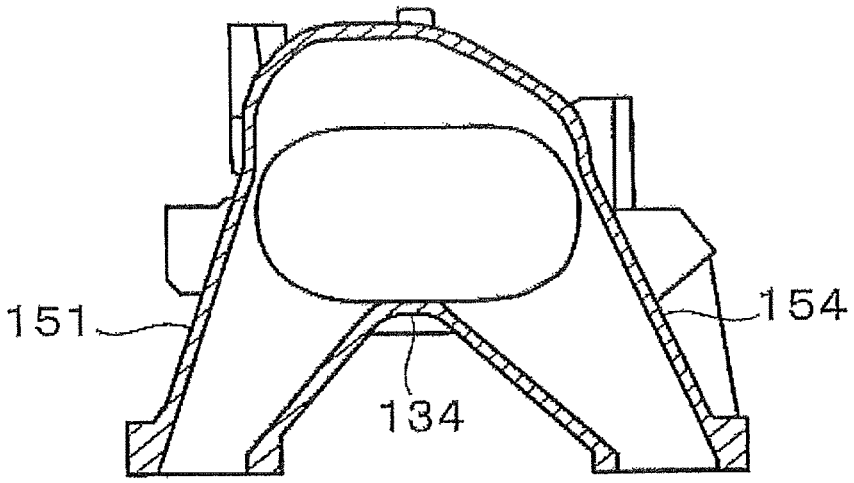
FIG. 5B CONVENTIONAL ART
Figure 6A:
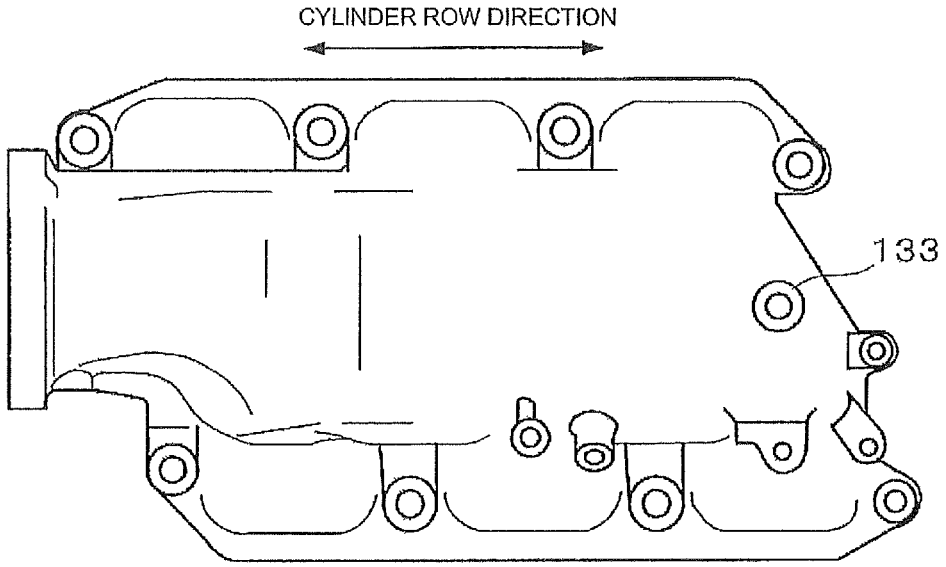
FIG. 6A CONVENTIONAL ART
FIGS. 6A and 6B are views (a plan view, a sectional view) for explaining a structure of a conventional surge tank which is shown for the sake of comparison.
Figure 6B:
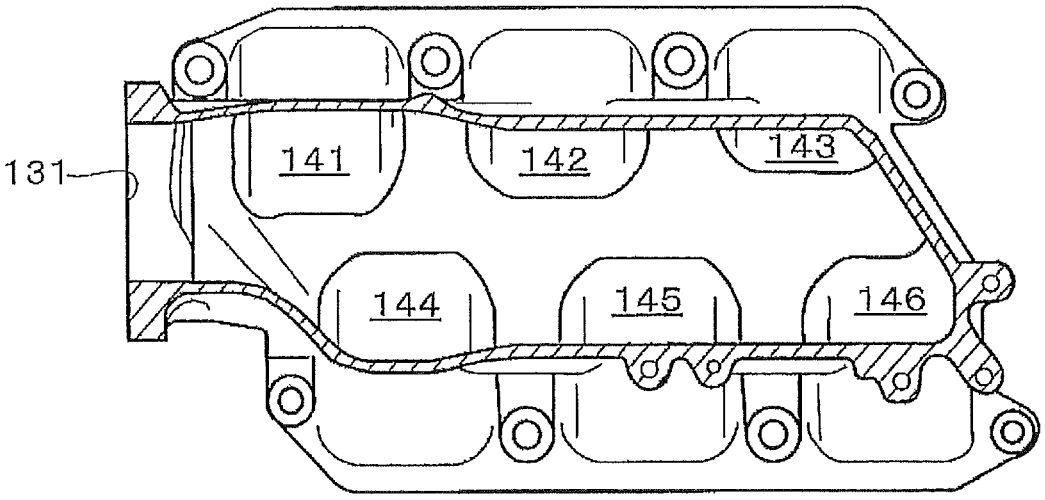
FIG. 6B CONVENTIONAL ART

FIGS. 3A and 3B, and 4A to 4C are views for explaining a distinctive structure of the surge tank 4 shown in FIG. 1. Constituent elements not directly related to features of the present invention such as the boss unit provided for attachment are not shown. FIG. 3A is a side view, and FIG. 3B is a sectional view taken along a line A-A of FIG. 3A. FIG. 4A is a plan view illustrating the surge tank 4, and FIG. 4B is a sectional view taken along a line B-B shown in FIG. 3A. FIG. 4C is a view in which an arrow (a line with an arrow) showing the flow of air flowing in from the intake path 2 is added to FIG. 4B. FIGS. 5A and 5B, and 6A and 6B are figures for explaining a structure of a conventional surge tank 104 which is shown for the sake of comparison. FIG. 5A is a side view, and FIG. 5B is a sectional view taken along a line A-A of FIG. 5A. FIG. 6A is a plan view illustrating the surge tank 104, and FIG. 6B is a sectional view taken along a line B-B shown in FIG. 5A.

The surge tank 4 includes an air inlet 31 which is connected to the intake path 2 and through which air flows in from the intake path 2, air outlets 41 to 46 in which upstream ends of the branch paths 51 to 56 of the cylinders #1 to #6 are open, a protrusion unit 32 provided on the lower wall surface between the two air outlets 41 and 44 closest to the air inlet 31 and for suppressing the air flow rate of air flowing out from these air outlets 41 and 44, and a blow-by gas path connection unit 33 connected to the blow-by gas path 6.

The protrusion unit 32 is formed so that the cross section thereof projects in a rectangular shape as shown in FIG. 3B and the projecting surface is a substantially horizontal flat surface, so that the protrusion unit suppresses the flow rate of the air flowing from the air outlet 41 to the branch path 51 and the flow rate of the air flowing from the air outlet 44 to the branch path 54. A portion of the lower inner wall surface of the surge tank 4 other than the protrusion unit 32, i.e., a portion between the air outlets 42 and 45 and a portion between the air outlets 43 and 46, is indicated by a broken line 34 in FIG. 3B, and the protrusion unit 32 is not provided. Arrows AL1 and AL2 indicate the flow of air flowing out of the air outlets 41 and 44.

The blow-by gas path connection unit 33 communicates with the inside of the surge tank 4 through an opening portion 33*a* provided on the upper wall portion of the surge tank 4. The blow-by gas path connection unit 33 is located in the vicinity of the air inlet 31 and above the protrusion unit 32.

The air outlets 41 to 43 are in communication with the combustion chambers of the cylinders #1 to #3 of the first bank 14 via branch paths 51 to 53, respectively. The air outlets 44 to 46 are in communication with the combustion chambers of the cylinders #4 to #6 of the second bank 15 via branch paths 54 to 56, respectively. The arrows AL3 to AL8 of FIG. 4C indicate the flows of airs flowing out from the air outlets 41 to 46, respectively.

An upper side wall surface 4*a* of the surge tank 4 is configured to linearly descend from the vicinity of the cylinder row direction end portion (one end) where the air inlet 31 is disposed toward the end portion (the other end) opposite to the air inlet 31.

In the conventional surge tank 104 shown in FIGS. 5A and 5B, and 6A and 6B, a lower side wall portion 134 between the air outlets 141 and 144 where the branch paths 151 and 154 are open as shown in FIG. 5B is formed in a saddle shape, so that the air smoothly flows into the branch paths 151 and 154. The portion between the air outlets 143 and 145 and the portion between the air outlets 144 and 146 are also formed in the same way.

A blow-by gas path connection unit 133 is provided at the end portion opposite to an air inlet 131 in the direction of the cylinder row. Furthermore, the upper side wall surface of the surge tank 104 is configured to include a curved portion 104*a* and a horizontal portion 104*b*.

Figure 7A:
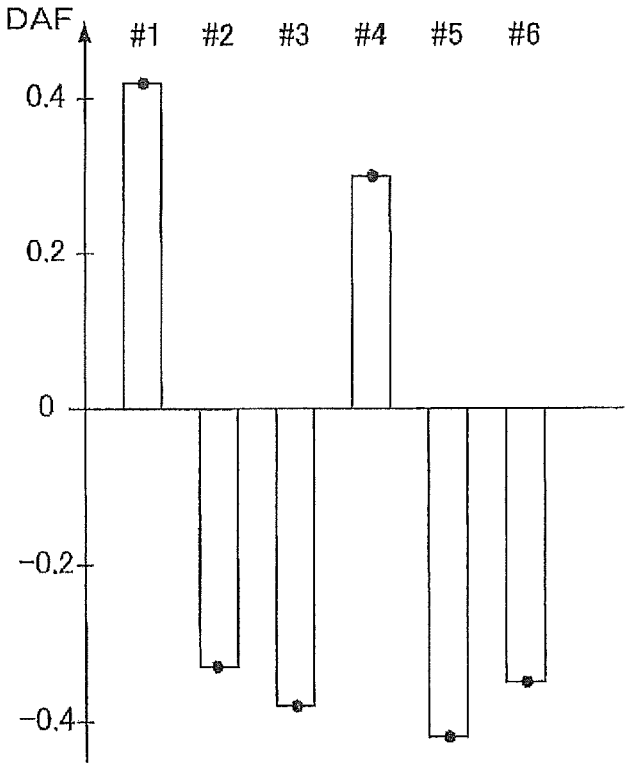
FIG. 7A CONVENTIONAL ART
FIGS. 7A and 7B are graphs for explaining problems associated with the use of the conventional surge tank and effects achieved by the surge tank according to the present invention.
Figure 7B:
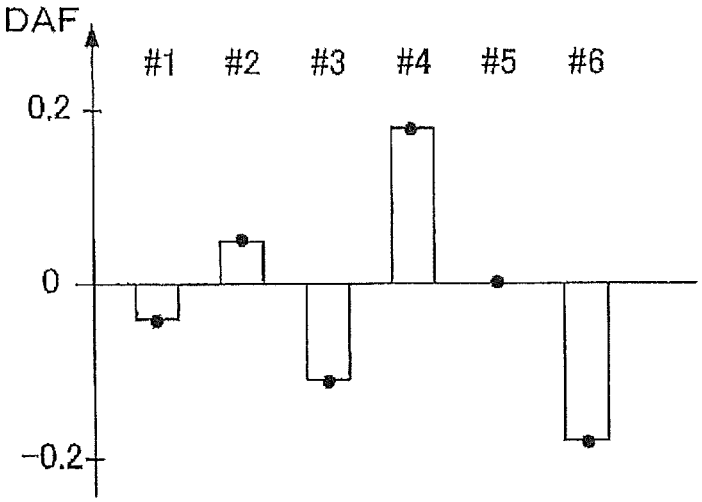

FIGS. 7A and 7B are graphs for explaining problems associated with the use of the conventional surge tank 104 and effects achieved by the surge tank 4 according to the present embodiment. FIGS. 7A and 7B illustrate a deviation DAF between the air-fuel ratios AFi (i=1 to 6) of the cylinders and the average air-fuel ratio AFAV. FIG. 7A corresponds to the conventional surge tank 104, and in FIG. 7A, the difference between the maximum value and the minimum value of deviation DAF is more than 0.8. FIG. 7B corresponds to the surge tank 4 according to the present embodiment, and in FIG. 7B, the difference between the maximum value and the minimum value of the deviation DAF is reduced to 0.4 or less.

The reduction effect of the deviation DAF indicating variation (imbalance) of the air-fuel ratio between the cylinders is mainly obtained by suppressing the air flow rate of air flowing into the combustion chamber of the cylinder #1 and the cylinder #4 by providing the protrusion unit 32, and is also attributed to the effect obtained by arranging the upper side wall surface 4*a* of the surge tank 4 to linearly descend from the vicinity of one end in the cylinder row direction where the air inlet 31 is disposed toward the other end opposite to the air inlet 31. The configuration of the upper side wall surface 4*a* provides the maximum capacity of the surge tank 4 within a limited space and also provides a smooth air flow towards the air outlet away from the air inlet.

In the conventional surge tank 104, the blow-by gas path connection unit 133 is provided at the end portion opposite to the air inlet 131 in the cylinder row direction, and therefore, there is a problem that a relatively large air-fuel ratio fluctuation occurs in particular cylinders (for example, the cylinder #4 and the cylinder #6) when the blow-by gas starts to flow into the surge tank 104. In the surge tank 4 according to the present embodiment, the blow-by gas path connection unit 33 is arranged near the air inlet 31, so that this promotes mixing of the blow-by gas and the intake air, and can prevent an increase in fluctuation of air-fuel ratios of particular cylinders when the blow-by gas starts to flow in.

As described above, according to the present embodiment, the protrusion unit 32 is provided on the lower wall surface between the air outlets 41 and 42 corresponding to the cylinder #1 and the cylinder #4, and therefore, the air flow rates flowing out through all the air outlets 41 to 46 are made to be uniformed and the variation of the air-fuel ratios between cylinders can be alleviated.

The present invention is not limited to the embodiments described above, and various modifications are possible. For example, although the example of the V-type internal combustion engine having six cylinders is shown in the above embodiment, the present invention is applicable not only to six cylinders but also to an intake apparatus of a V-type internal combustion engine constituted by an even number of cylinders. For example, when the present invention is applied to an internal combustion engine having eight cylinders or ten cylinders, it is desirable to extend the protrusion unit 32 to the other end in the cylinder row direction in accordance with the state of the deviation DAF of the air-fuel ratio.

According to a first embodiment of the invention, there is provided an intake apparatus of a V-type internal combustion engine (1) in which a plurality of cylinders (#1 to #6) are arranged in a first bank (14) and a second bank (15), the intake apparatus (1) including: a surge tank (4) arranged above the first and second banks; an intake path (2) connected to an air inlet (31) of the surge tank; and a branch path (51 to 56) allowing communication between the surge tank (4) and a combustion chamber each of the plurality of cylinders, wherein the surge tank (4) includes a plurality of first air outlets (41 to 43) in which upstream ends of branch paths (51 to 53) in communication with the combustion chambers of the cylinders (#1 to #3) in the first bank are open and which are arranged in a cylinder row direction of the first bank and a plurality of second air outlets (44 to 46) in which upstream ends of branch paths (54 to 56) in communication with the combustion chambers of the cylinders (#4 to #6) in the second bank are open and which are arranged in a cylinder row direction of the second bank, the air inlet (31) is arranged at one end in the cylinder row direction of the first and second banks (14, 15), and a protrusion unit (32) for suppressing an air flow rate of air flowing out from two particular air outlets which are of the first and second air outlets (41 to 46) and which are close to the air inlet (31) is provided on a lower wall surface between the two particular air outlets (41, 44).

A conventional intake apparatus which is obtained by simply reducing the capacity of a conventional surge tank is found to have such a tendency that an air flow rate of air flowing out to a branch path via particular air outlets close to an air inlet increases more greatly than the air flow rates of air flowing out through the other air outlets, and a protrusion unit is provided on a lower wall surface between two particular air outlets close to the air inlet, so that the air flow rates flowing out through all the air outlets are made to be uniform and the fluctuation of the air-fuel ratios between cylinders can be reduced.

According to a second embodiment of the invention, in the intake apparatus of a V-type internal combustion engine, the surge tank (4) is connected to a blow-by gas path communicating with a crankcase of the engine, and in the surge tank (4), a blow-by gas path connection unit (33) connected to the blow-by gas path is disposed in proximity to the air inlet (31).

According to this configuration, the blow-by gas path opening portion of the surge tank is located near the air inlet, and this promotes mixing between the blow-by gas and the intake air, and can prevent an increase in fluctuation of the air-fuel ratios of particular cylinders when the blow-by gas starts to flow in.

According to a third embodiment of the invention, in the intake apparatus of a V-type internal combustion engine, an upper side wall surface (4*a*) of the surge tank is configured to linearly descend from vicinity of the one end where the air inlet (31) is disposed toward the other end in the cylinder row direction.

According to this configuration, a maximum surge tank capacity can be ensured within a limited space, and smooth airflow toward the air outlet away from the air inlet can be obtained, and therefore, fluctuation of the air-fuel ratios between cylinders can be further alleviated.

Obviously, numerous modifications and variations of the present invention are possible in light of the above teachings. It is therefore to be understood that within the scope of the appended claims, the invention may be practiced otherwise than as specifically described herein.

What is claimed is:

1. An intake apparatus of a V-type internal combustion engine in which a plurality of cylinders is arranged in a first bank and a second bank, the intake apparatus comprising:

a surge tank arranged above the first and second banks;

an intake path connected to an air inlet of the surge tank; and a plurality of branch paths, wherein each of the plurality of branch paths allows communication between the surge tank and a respective combustion chamber of each of the plurality of cylinders, wherein the surge tank includes a plurality of first air outlets in which upstream ends of branch paths in communication with the combustion chambers of the cylinders in the first bank are open and which are arranged in a cylinder row direction of the first bank and a plurality of second air outlets in which upstream ends of branch paths in communication with the combustion chambers of the cylinders in the second bank are open and which are arranged in a cylinder row direction of the second bank, the air inlet is arranged at one end in the cylinder row direction of the first and second banks, and a protrusion unit for suppressing an air flow rate of air flowing out from two particular air outlets which are of the first and second air outlets and which are close to the air inlet is provided on a lower wall surface between the two particular air outlets, the protrusion unit extends to a height above a portion of each of the two particular air outlets.

2. The intake apparatus according to claim 1, wherein the surge tank is connected to a blow-by gas path communicating with a crankcase of the V-type internal combustion engine, and in the surge tank, a blow-by gas path connection unit connected to the blow-by gas path is disposed in proximity to the air inlet.

3. The intake apparatus according to claim 1, wherein an upper side wall surface of the surge tank is configured to linearly descend from vicinity of the one end where the air inlet is disposed toward another end in the cylinder row direction.

4. The intake apparatus according to claim 1, wherein the protrusion unit is provided on the lower wall surface at a location that is not between all of the first and second air outlets.

5. The intake apparatus according to claim 1, wherein the protrusion unit includes a portion with a horizontal flat surface.

6. The intake apparatus according to claim 1, wherein the plurality of first air outlets and the plurality of second air outlets are provided in the lower wall surface.

7. An intake apparatus of a V-type internal combustion engine including first cylinders arranged along a first direction in a first bank and second cylinders arranged along the first direction in a second bank, the intake apparatus comprising:

a surge tank provided above the first bank and the second bank in a height direction of the V-type internal combustion engine and comprising:

a first end;

a second end opposite to the first end in the first direction;

an upper wall;

a lower wall opposite to the upper wall in the height direction;

an air inlet provided in the first end;

first air outlets arranged along the first direction in the lower wall, the first air outlets including a closest first air outlet closest to the air inlet among the first air outlets; and second air outlets arranged along the first direction in the lower wall, the second air outlets including a closest second air outlet closest to the air inlet among the second air outlets;

an intake path connected to the air inlet;

first branch paths connecting the first air outlets to the first cylinders, respectively;

second branch paths connecting the second air outlets to the second cylinders, respectively; and a protrusion provided on the lower wall to protrude toward the upper wall between the closest first air outlet and the closest second air outlet so as to suppress air flows output from the closest first air outlet and the closest second air outlet, the protrusion extends to a height above a portion of each of the closest first air outlet and the closest second air outlet.

8. The intake apparatus according to claim 7, wherein the surge tank is connected to a blow-by gas path communicating with a crankcase of the V-type internal combustion engine, and in the surge tank, a blow-by gas path connection unit connected to the blow-by gas path is disposed in proximity to the air inlet.

9. The intake apparatus according to claim 7, wherein the upper wall of the surge tank is configured to linearly descend from vicinity of the first end where the air inlet is disposed toward the second end in the first direction.

10. The intake apparatus according to claim 7, wherein the protrusion is provided on the lower wall at a location that is not between all of the first air outlets and the second air outlets.

11. The intake apparatus according to claim 7, wherein the protrusion includes a portion with a horizontal flat surface.

12. The intake apparatus according to claim 7, wherein the first air outlets and the second air outlets are provided in the lower wall.

13. An intake apparatus of a V-type internal combustion engine including first cylinders arranged along a first direction in a first bank and second cylinders arranged along the first direction in a second bank, the intake apparatus comprising:

a surge tank provided above the first bank and the second bank in a height direction of the V-type internal combustion engine and comprising:

a first end;

a second end opposite to the first end in the first direction;

an upper wall;

a lower wall opposite to the upper wall in the height direction;

an air inlet provided in the first end;

first air outlets arranged along the first direction in the lower wall, the first air outlets including a closest first air outlet closest to the air inlet among the first air outlets; and second air outlets arranged along the first direction in the lower wall, the second air outlets including a closest second air outlet closest to the air inlet among the second air outlets;

an intake path connected to the air inlet;

first branch paths connecting the first air outlets to the first cylinders, respectively;

second branch paths connecting the second air outlets to the second cylinders, respectively; and a protrusion protruding toward the upper wall between the closest first air outlet and the closest second air outlet so as to suppress air flows output from the closest first air outlet and the closest second air outlet, the protrusion being a part of the lower wall, the protrusion extends to a height above a portion of each of the closest first air outlet and the closest second air outlet.

14. The intake apparatus according to claim 13, wherein the protrusion is provided on the lower wall at a location that is not between all of the first air outlets and the second air outlets.

15. The intake apparatus according to claim 13, wherein the protrusion includes a portion with a horizontal flat surface.

16. The intake apparatus according to claim 13, wherein the first air outlets and the second air outlets are provided in the lower wall.

* * * * *